US011884433B2

(12) United States Patent
Söderström et al.

(10) Patent No.: US 11,884,433 B2
(45) Date of Patent: Jan. 30, 2024

(54) CONTAINER COMPRISING A PLURALITY OF PORTION PACKETS OF A PRODUCT FOR ORAL USE

(71) Applicant: Swedish Match North Europe AB, Stockholm (SE)

(72) Inventors: Patrik Söderström, Alingsås (SE); Daniel Hafstad, Frillesås (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 337 days.

(21) Appl. No.: 17/330,459

(22) Filed: May 26, 2021

(65) Prior Publication Data

US 2021/0380288 A1 Dec. 9, 2021

Related U.S. Application Data

(62) Division of application No. 16/344,168, filed as application No. PCT/EP2017/077467 on Oct. 26, 2017, now Pat. No. 11,046,464.

(30) Foreign Application Priority Data

Nov. 9, 2016 (EP) ..... 16197948

(51) Int. Cl.

| | |
|---|---|
| ***A24F 23/00*** | (2006.01) |
| ***B65B 5/08*** | (2006.01) |
| ***B65B 5/06*** | (2006.01) |
| ***B65B 5/10*** | (2006.01) |
| ***B65B 39/00*** | (2006.01) |
| ***B65B 39/12*** | (2006.01) |
| ***B65B 29/00*** | (2006.01) |

(52) U.S. Cl.

CPC ..... *B65B 5/08* (2013.01); *B65B 5/061* (2013.01); *B65B 5/101* (2013.01); *B65B 29/00* (2013.01); *B65B 39/007* (2013.01); *B65B 39/12* (2013.01); *A24F 23/00* (2013.01); *B65B 2220/18* (2013.01); *B65B 2230/00* (2013.01)

(58) Field of Classification Search

CPC ..... A24F 23/00; A24F 23/02

See application file for complete search history.

(56) References Cited

U.S. PATENT DOCUMENTS 3,951,399 A 4/1976 Reist
4,124,969 A 11/1978 Beer et al.
(Continued)

FOREIGN PATENT DOCUMENTS

DE 1932852 A1 1/1971
DE 3621066 A1 1/1988
(Continued)

OTHER PUBLICATIONS

International Search Report dated Dec. 22, 2017 by the International Searching Authority for Application No. PCT/EP2017/077467, which was filed on Oct. 26, 2017 and published as WO 2018/086902 (Inventor—Söderström et al.; Applicant—Swedish Match North Europe AB) (3 pages).

(Continued)

*Primary Examiner* — Javier A Pagan
(74) *Attorney, Agent, or Firm* — Ballard Spahr LLP

(57) ABSTRACT

The disclosure relates to a container comprising a plurality of portion packets of a product for oral use.

9 Claims, 11 Drawing Sheets

(56) References Cited

U.S. PATENT DOCUMENTS

| | | | | |
|---|---|---|---|---|
| 4,703,765 | A | 11/1987 | Paules et al. | |
| 4,989,391 | A | 2/1991 | Wetter | |
| 6,135,120 | A | 10/2000 | Lofman et al. | |
| D674,537 | S * | 1/2013 | Macko | D27/100 |
| 9,487,313 | B2 | 11/2016 | Aspgren | |
| 9,527,611 | B2 | 12/2016 | Lofman et al. | |
| D784,606 | S * | 4/2017 | Rushforth | D27/100 |
| D822,505 | S * | 7/2018 | Gibson | D9/721 |
| 10,815,038 | B2 * | 10/2020 | Rehders | B65D 79/02 |
| 2012/0000164 | A1 | 1/2012 | Boldrini | |
| 2013/0232922 | A1 | 9/2013 | Aspgren | |
| 2013/0239517 | A1 | 9/2013 | Lofman et al. | |
| 2015/0122675 | A1 | 5/2015 | Aspgren | |

FOREIGN PATENT DOCUMENTS

| | | | |
|---|---|---|---|
| DE | 102015105295 | A1 | 10/2016 |
| EP | 2457834 | A1 | 5/2012 |
| EP | 24578331 | A1 | 5/2012 |
| GB | 1375703 | A | 11/1974 |
| JP | 2013 543822 | A | 12/2013 |
| KR | 101469677 | B1 | 12/2014 |
| WO | WO 2004/060553 | A1 | 7/2004 |

OTHER PUBLICATIONS

International Preliminary report on Patentability dated Mar. 29, 2019 by the International Searching Authority for Application No. PCT/EP2017/077467, which was filed on Oct. 26, 2017 and published as WO 2018/086902 (Inventor—Söderström et al.; Applicant—Swedish Match North Europe AB) (19 pages).

International Search Report was dated Oct. 7, 2020 by the International Searching Authority for International Application No. PCT/KR2020/007437 filed on Jun. 9, 2020 and published as WO 2020/256328 (Applicant—Heesung Catalysts Corporation) (3 pages).

* cited by examiner

CONTAINER COMPRISING A PLURALITY OF PORTION PACKETS OF A PRODUCT FOR ORAL USE

CROSS-REFERENCE TO RELATED APPLICATIONS

This application is a divisional application of U.S. patent application Ser. No. 16/344,168, filed Apr. 23, 2019, issued as U.S. Pat. No. 11,046,464 on Jun. 29, 2021, which is a U.S. National Phase Application of International Application No. PCT/EP2017/077467, filed Oct. 26, 2017, which claims priority to European Application No. 16197948.9, filed Nov. 9, 2016, each of which are hereby incorporated by reference in their entirety.

TECHNICAL FIELD

The present disclosure relates to a method for positioning portion packets of a product for oral use into a container. The disclosure further relates to a device for positioning portion packets of a product for oral use into a container. The disclosure also relates to a container comprising a plurality of portion packets of a product for oral use.

BACKGROUND

Typically, a portion packet of a product for oral use comprises a filling material enclosed by a packaging material. An example of such a portion packet is a portion-packed pouched oral smokeless tobacco product. Pouched smokeless tobacco products may be produced by measuring portions of the smokeless tobacco composition and inserting the portions into a nonwoven tube.

Patent document U.S. Pat. No. 4,703,765 discloses a device for packaging precise amounts of finely divided tobacco products, such as snuff tobacco or the like, in a tubular packaging material into which snuff portions are injected via a fill tube. Downstream from the tube, welding means are positioned for transverse sealing of the packaging material and also cutting means for severing the packaging material in the area of the transverse seal to thus form discrete or individual portion packets.

As an alternative, finely divided tobacco products, such as snuff tobacco or the like, may be placed on a planar web of packaging material as a portion before the planar web is formed to a tubular-shape, e.g. according to a technique called "NYPS" described in U.S. Pat. No. 6,135,120. Thereafter the packaging material is wrapped around the already placed snuff portion to form the tubular-shaped packaging material, thereby enclosing the snuff portion. The arranged packaging material is then sealed by a longitudinal seal. A subsequent unit forms individual portion packets from the discharged portions and the packaging material.

In order to store and transport the portion packets, it is desirable to place them in a container. Traditionally, a preselected number of portion packets have simply been allowed to tumble down into the container. The portion packets then end up in an arbitrary three-dimensional arrangement, which will differ from one container to the next. There is then a possibility that a portion packet may assume such a disadvantageous position that it risks being squeezed between the container and a lid, which is applied to the container. In that case, it may be difficult to open the lid and the squeezed portion packet may break.

It has been found that portion packets positioned in a predefined pattern in the container provide a more attractive appearance to the user. Further, the portion packets may be packed into the container quicker and/or more geometrically efficient, i.e. space-saving. However, the portion packets may be relatively difficult to handle at high speed in automated processes, since they may be soft and somewhat sticky. The production rate in portion packing processes is very high, typically several hundreds of portion packets per minute.

Patent document EP 2457834 A1 discloses a device for placing portion packets of a product for oral use in a container. The device comprises a portion packet positioning unit configured to position the portion packets in relation to each other in the container, wherein the positioning unit includes a set of portion packet receiving compartments arranged in a certain pattern, each of the compartments having an entrance end allowing a portion packet to enter the compartment and, at an opposite side of the compartment, a retaining end preventing a portion packet from exiting the compartment in that direction. The positioning unit further comprises a discharging member configured to discharge portion packets from the compartments to the container. The disclosure of EP 2457834 A1 also relates to a method for placing portion packets of a product for oral use into a container using such a device. According to EP 2457834 A1, the three-dimensional pattern in which the portion packets are positioned in the compartments is substantially retained in the container.

Patent document DE 19 32 852 A1 discloses a device for placing bags, e.g. filled by a liquid, in compartments of a container, e.g. a cardboard box. The device comprises a plurality of canals located beside and/or behind each other, which are closable at their lower ends by means of a flap and below which a lifting device for the containers is located.

SUMMARY

The object of the present disclosure is to overcome or ameliorate at least one of the disadvantages of the prior art, or to provide a useful alternative.

The object above may be achieved by the subject-matter of claim 1. Embodiments are set forth in the appended dependent claims, in the following description and in the drawings.

Thus, there is provided a method for positioning portion packets of a product for oral use into a container by means of a compartment unit. The container comprises a bottom wall and a side wall together defining a storage volume. The container has a height direction. The compartment unit comprises a plurality of compartments, each with a respective discharge opening.

The method comprises:

a) positioning the compartment unit at a first distance $d_1$ from the bottom wall of the container with the discharge openings facing the storage volume of the container, b) introducing at least one portion packet into i-th compartment of the compartment unit, the portion packet thereby assuming a first three-dimensional orientation with the at least one portion packet being in contact with the bottom wall of the container and at least partly remaining in the i-th compartment, wherein i is an integer going from 1 to n, n being the number of compartments to be loaded, $n \geq 2$, c) moving the compartment unit in relation to the container, thereby causing reconfiguration of each portion packet to a second three-dimensional orientation being different from the first three-dimensional orientation.

As mentioned above, a portion packet of a product for oral use comprises a filling material enclosed by a packaging material. The packaging material may be made of a nonwoven material, e.g. comprising viscose, optionally including an acrylic polymer that acts as binder in the nonwoven material and provides for thermo-welding of pouches during manufacturing thereof. Nonwovens are fabrics that are neither woven nor knitted. Methods for the manufacturing of nonwoven, as well as suitable polymer materials for the nonwoven, are commonly known in the art.

The filling material may comprise a pulverulent material, such as a smokeless tobacco or tobacco-free material, which may be nicotine-containing or nicotine free, which may also be referred to as filling composition or snuff composition. As an alternative, the filling material may be tea or another food product.

By the term "pulverulent material" as used herein is meant any material in the form of particles, granules, grinds, plant fragments, short fibres, flakes etc.

The portion packet is commonly provided with a transverse seal at either end, such that the sealed product has a pillow-like shape, e.g. having a general rectangular shape when seen from above. Square is herein seen as a special case of rectangular. The portion packet then has a length l and a width w. The transverse seal is substantially perpendicular to a direction of travel of the tubular-shaped packaging material. The pouched product may further, as an option, be provided with a longitudinal seal, which is substantially parallel to the direction of travel of the tubular-shaped packaging material. Commonly, the tubular-shaped packaging material is first longitudinally sealed to form a circumferentially closed tubular shape and then transversely sealed. The pillow-like shape comprises two parallel short edges and two parallel long edges, which are perpendicular to the short edges. A respective transverse seam may be arranged at the short edges. The longitudinal seam is typically not located at the long edges. Instead it may, for example, be located substantially halfway between the long edges.

By the term "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g., granulated or encapsulated.

The term "tobacco material" is used herein for tobacco leaves or parts of leaves, such as lamina and stem. The leaves and parts of leaves may be finely divided or disintegrated, such as ground, cut, shredded or threshed, and the parts of leaves may be blended in defined proportions in the tobacco material.

"Oral" and "oral use" is in all contexts used herein as a description for use in the oral cavity of a human, such as buccal placement.

Portion packets of pouched oral smokeless tobacco products are normally sized and configured to fit comfortably and discreetly in a user's mouth between the upper or lower gum and the lip. In general, the portion packets have a generally rectangular shape. Some typical shapes, length×width, of commercially available pouched oral smokeless tobacco products are, for instance, 35 mm×20 mm, 34/35 mm×14 mm, 33/34 mm×18 mm, and 27/28 mm×14 mm. Each pouched oral snuff product may have a maximum length within the range of from 25 mm to 35 mm along the longitudinal direction of the product and a maximum width within the range of from 12 mm to 20 mm along the transverse direction of the product. The thickness, i.e. height, of the portion packet is normally within the range of from 2 mm to 8 mm. The total weight of commercially available portion packets of oral smokeless tobacco products are typically within the range from about 0.3 g to about 3.5 g, such as from about 0.5 g to 1.7 g per portion packet.

The first distance $d_1$, mentioned in step a of the method, is preferably less than an extension of the portion packets in the height direction of the container. Assuming the portion packets have a pillow-like shape, the portion packets may abut on one of their short edges on the bottom wall of the container. In that case, the extension of the portion packet equals the length l of the portion packet and it is preferred that $0 \leq d_1 < 1$. If instead abutting on a long edge, the extension equals the width w of the portion packet and it would be preferred that $0 \leq d_1 < w$. Thereby, the portion packets will at least partly be retained in the compartments. Preferably, the first distance $d_1$ is very small, i.e. close to zero, but yet large enough to allow the compartment unit to rotate in relation to the container, which may be used for sequentially introducing the portion packets in the compartments.

In step b, i is an integer going from 1 to n, i.e. step b is repeated n times, $n \geq 2$. The number n is the number of compartments to be loaded, i.e. filled by at least one portion packet, and is typically in the range from 5 to 30, preferably from 10 to 25. If there is to be a single portion packet in each compartment, the number n of portion packets intended to be positioned in the container will also equal n. However, the number of portion packets in the container may also be higher than n, if placing more than a single portion packet in the same compartment, as is further explained below.

The step of introducing a portion packet, see step b, is normally repeated for each compartment of the compartment unit. If the compartment unit has a cross-section being a full circle, a semi-circle or any other part of a circle, it is suitable to rotate the compartment unit into a suitable position for introducing a portion packet into the next compartment. If instead the compartment unit has a rectangular cross-section, it is suitable to linearly translate the compartment unit into a suitable position for introducing a portion packet into the next compartment. Square is herein seen as a special case of rectangular. If rectangular, the portion packets may be arranged in one, two, three or more parallel lines.

It would also be feasible to fill two, three, etc. . . . , or even all compartments at the same time. Further, it could be feasible to load the compartments first and then position the compartment unit in relation to the container. In that case, it may be desirable to temporarily block the discharge openings, such that the portion packets do not fall out of the compartment unit before it has been positioned in relation to the container.

Each compartment may be adapted to receive a single portion packet. It would also be feasible to have two, three or more portion packets in the same compartment. In that case, one portion packets may be located inside the other in the same compartment, such that the edge of one portion packet faces the edge of the other. Alternatively the portion packets may be located next to each other with their largest sides facing each other. As yet an alternative, one portion packets may be located on top of the other in the same compartment. These variants may also be combined. A compartment unit may comprise compartments of different types, e.g. a mixture of compartments intended for a single portion packet and compartments intended for two portion packets.

Step c comprises a controlled reconfiguration of the portion packets. In step c, one of the compartment unit and the container may be moved and the other may be held still. Preferably, the compartment unit is displaced and the container is held still. It is also possible that both the compartment unit and the container are moved.

Step c may be performed by:

c1) moving the compartment unit in relation to the container by relative movement in the height direction of the container at least until each portion packet is located outside the corresponding compartment, and c2) allowing each portion packet to fall down on an adjacent portion packet, such that one portion packet partly overlaps with the adjacent portion packet in the second three-dimensional orientation.

The overlap helps the portion packets to retain their relative positions, resulting in a stable distribution of portion packets within the container, which is obtained after the portion packets have been discharged into the container. This three-dimensional pattern may be referred to as a packaging pattern or a display pattern, as it is the pattern, which is presented to a user when opening the container. This pattern provides an attractive and highly functional display of the packaged portion packets. The obtained packaging pattern can remain stable, even if the container, being closed by a corresponding lid, is carried around in a pocket of the user and/or if the container is shaken. Further, the pattern configuration provides a user with an easy way to estimate the number of portion packets in the container. In addition, the exposed free edges of the portion packets may be immediately identified and easily grasped when the user wants to take a portion packet from the container. Additionally, this pattern configuration may help to obtain a regular distribution of the filling material within the portion packet.

Since the compartments typically are larger than the portion packets, the portion packets tend to be somewhat inclined in first three-dimensional orientation. The first three-dimensional orientation may also be influenced by the compartment unit being moved during introduction of the portion packets. The compartment unit may for example be stepwise moved during the introduction, e.g. stepwise rotated or stepwise linearly translated.

When the compartment unit has been raised in relation to the container in step c1, the whole portion packets are located outside the compartment unit and will therefore fall down. Due to the somewhat inclined first three-dimensional orientation, the portion packet has a preferred falling direction and will tilt about the portion being in contact with the bottom wall of the container, typically being an edge. Thereby, the portion packets will be brought to the second three-dimensional orientation by a controlled reconfiguration. If the compartments are regularly arranged, which is preferred, the portion packets will fall down in a staggered, domino-like pattern.

As an alternative, or complement, to the above way of performing step c, step c may be performed by:

c1') positioning the compartment unit in relation to the container at a second distance from the bottom wall of the container, wherein a portion of each portion packet is outside the corresponding compartment, and another portion of each portion packet is inside the corresponding compartment.

c2') moving the compartment unit in relation to the container by relative movement of the compartment unit in a reconfiguration plane being perpendicular to the height direction of the container, when positioned at the second distance from the bottom wall of the container, thereby causing reconfiguration of each portion packet to the second three-dimensional orientation.

In step c1', the compartment unit is positioned at the second distance $d_2$ from the bottom wall of the container. If the portion packets abut on one of their short edges on the bottom wall of the container, comparison is made to the length l of the portion packet, such that $d_2<1$. Suitably, $0.25\ l<d_2<0.99\ l$, or preferably $0.4\ l<d_2<0.95\ l$, or more preferably $0.6\ l<d_2<0.95\ l$. If instead abutting on a long edge, comparison is instead made to the width w of the portion packets $d_2<w$, such that suitably $0.25\ w<d_2<0.99\ w$, or preferably $0.4\ w<d_2<0.95\ w$, or more preferably $0.6\ w<d_2<0.95\ w$. The second distance may be larger than or equal to the first distance. In any case, the second distance should be large enough to obtain the desired controlled reconfiguration of the portion packets to the second three-dimensional orientation, in which the portion packets are partly overlapping, and yet small enough so that a portion of each portion packet is still retained in the compartment, such that this portion packet may be moved by the compartment unit, e.g. by a wall member of the compartment. If the compartment unit is arranged vertically above the container, this portion will be the upper portion.

When the compartment unit is moved in relation to the container in step c2' by relative movement of the compartment unit in the reconfiguration plane, a portion of each portion packet will be moved by the compartment unit, while the other portion of the portion packet remains abutting the bottom wall of the container. Thereby the portion packets will be brought to the second three-dimensional orientation. If the portion packet abuts on one of its edges before the displacement, i.e. in the first three-dimensional orientation, the portion packet will tilt in the manner of dominos, such that the portion packet partly overlaps with an adjacent portion packet, i.e. the portion packet partly lies on top of the adjacent portion packet in the second three-dimensional orientation in a staggered, domino-like pattern. In the second three-dimensional orientation, the portion packets may assume a pre-definable three-dimensional pattern of portion packets in the container, which may be regular, i.e. the portion packets partly overlap with each other in a similar way. The length of the relative movement in step c2' is preferably selected to be large enough to cause the desired tilting of the portion packets.

The relative movement in step c2' may be performed by a rotational movement and/or a linear translational movement in the reconfiguration plane of the compartment unit in relation to the container. The rotational movement may be particularly suitable if the compartment unit has a cross-section being a full circle, a semi-circle or any other part of a circle. The linear translational movement may be particularly suitable if the compartment unit has a rectangular cross-section. Preferably, the compartment unit is moved and the container is held still. However, it is also possible that the container is moved and the container unit is held still, or that both of them are moved.

As an additional option, the compartment unit may be raised after the relative movement performed in step c2', such that the portion packets are allowed to fall down on each other from their tilted position resulting from the relative movement of step c2' to the second three-dimensional orientation.

Steps c1' and c2' may be performed simultaneously, or at least partly simultaneously, such that the compartment unit is positioned in relation to the container to second distance from the bottom wall at the same time as the compartment unit is moved in the reconfiguration plane. For example, the compartment unit may be moved upwards while being rotated. As another example, the compartment unit may first be moved straight upwards then be moved upwards while being rotated.

In addition, steps c1 and c2 may be combined with steps c1' and c2'.

The method may further comprise a step of d) displacing the compartment unit in relation to the container in the height direction of the container, such that the compartment unit applies pressure to the portion packets when assuming the second three-dimensional orientation.

Step d is carried out after step c. Thereby the portion packets may be locally compressed by means of the compartment unit. This will help to form a neat pattern of portion packets and to retain a stable configuration of the portion packets in the container. The pressure may be applied with the compartment unit being at a third distance from the bottom wall of the container, which third distance is less than the second distance.

The portion packet may be introduced into the compartment, such that one of its edges faces the bottom wall of the container, preferably one of its short edges.

The distance from one portion packet to the adjacent portion packet when located in the compartment unit is preferably less than an extension of the portion packets in the height direction of the container, being the length l or the width w, when the portion packets assume the first three-dimensional orientation. Thereby, the desired configuration of the portion packets in the container, such that the portion packets partly overlap each other, is easily obtained. The distance from one portion packet to the adjacent portion packet is determined as the smallest distance from a geometrical center of one portion packet to the geometrical center of the adjacent portion packet.

This disclosure further relates to a device for positioning portion packets of a product for oral use into a container. The device comprises a compartment unit, comprising a plurality of compartments for receiving at least one portion packet, and a positioning unit, having an axial direction. The positioning unit is adapted to displace the compartment unit in a first displacement motion in the axial direction of the positioning unit. The first displacement motion is used to adjust the interspace between the compartment unit and the container, cf. steps a, c1' and the optional step d of the method described above. The axial direction is parallel to the height direction of the container.

The compartment unit forms a rigid structure, which is adapted to hold the portion packets in the first predefined three-dimensional pattern given by the compartment pattern, which pattern however is changed in step c to the second selectable three-dimensional pattern, which is the pattern of the portion packets in the container, which may also be referred to as the packaging pattern or the display pattern, as it is the pattern, which is presented to a user when opening the container.

The compartments are preferably arranged side-by-side, such that a single wall member forms a dividing wall between two adjacent compartments.

The positioning unit may also be adapted to displace the compartment unit in a second displacement motion in the reconfiguration plane being perpendicular to the axial direction. The second displacement motion is used for the displacement movement in step c2'. In addition, the second displacement motion may be used during introduction of the portion packets into the compartments, see step b.

The compartments may be arranged in a compartment pattern forming a first sequence being a full circle, a semi-circle or any other part of a circle. The compartments may then be wedge-shaped, wherein the wider end of the wedge shape forms an entrance end of the compartment. By utilizing the method as described herein, especially if the portion packets abut on one of their edges on the bottom wall of the container, it may be avoided that the portion packets assume a wedge-shape in the container, since they instead overlap each other.

The compartments may be arranged in a compartment pattern forming the above first sequence and in a second sequence, being a full circle, a semi-circle or any other part of a circle, the second sequence preferably being concentric with the first sequence. Further the second sequence preferably has the same general shape as the first sequence, e.g. both being full circles. The number of compartments in the second sequence is normally less than in the first sequence, e.g. a half, a third or a fourth. The number of compartments in the first sequence may be a multiple of the number of compartments in the second sequence.

The device may comprise a center column located at a center of the compartment unit, the center column being displaceable in relation to the compartments in the axial direction, which is parallel to the height direction of the container. The center column may e.g. be spring-biased, such that the center column protrudes from the compartments when the compartment unit is positioned spaced from the bottom wall of the container. The center column may help to keep the portion packets in place during the first displacement motion and/or the second displacement motion and to achieve a controlled reconfiguration of the portion packets. The center column prevents the portion packets from sliding into the center of the container. The center column may have a diameter in the range of from 0% to 80%, preferably in the range of from 20% to 60%, more preferably in the range of from 30% to 50% of the diameter of the compartment unit. An optional indentation at the end of the center column may be adapted to fit on a corresponding protuberance of the bottom wall of the container.

The compartments may be configured such that each of the compartments has an entrance end, at which a portion packet may be introduced into the compartment in an entrance direction, a retaining end opposite the entrance end, the retaining end preventing the portion packet from further movement when being introduced, and a discharge opening facing in a direction being perpendicular to a straight line drawn between the entrance end and the retaining end. The discharge opening is thereby adapted to face the container.

The device may further comprise a transport unit configured to transport individual portion packets to the compartment unit, wherein the transport unit comprises a product channel arranged for transportation of individual portion packets.

The portion packets may be transported by means gravity and/or pressurized gas. The product channel forms an angle $\alpha$ to a horizontal plane. If using gravity only, the angle $\alpha$ may be in the range from 30° to 90°, preferably from 40° to 80°, more preferably from 50° to 70°. If using pressurized gas, any angle would work since the portion packet will be moved by the pressurized gas. If using pressurized gas, the product channel may be configured like the product channel described in EP 2457834 A1.

It is preferred that the product channel is configured to introduce each individual portion packet into the compartment with a predefined three-dimensional orientation in relation to the compartment, more preferably such that an edge of each portion packet faces a bottom wall of the container, most preferably one of the short edges of the portion packet.

Such a transport unit can also be used to introduce portion packets into other types of devices for positioning portion packets of a product for oral use into a container than the device disclosed herein, e.g. into the device described in EP 2457834 A1.

The device may further comprise a packaging unit configured to wrap the packaging material around the filling material, wherein the packaging unit is arranged upstream of the transport unit, such that portion packets fed to the transport unit comprise portions of filling material wrapped in the packaging material. Examples of such packaging units are given in the above-mentioned patent documents U.S. Pat. Nos. 6,135,120 and 4,703,765.

The disclosure further relates to a container comprising a plurality of portion packets of a product for oral use. The container comprises a bottom wall and a side wall together defining a storage volume, in which the portion packets are contained. The container has a height direction. The portion packets have a pillow-like shape, the shape comprising two parallel short edges and two parallel long edges, which are perpendicular to the short edges. The portion packets are arranged such that one portion packet partly overlaps with an adjacent portion packet, wherein the portion packets are arranged such that one of the short edges of each portion packet abuts the bottom wall of the container.

This disclosure further relates to a container comprising a plurality of portion packets of a product for oral use. The portion packets are arranged such that one portion packet partly overlaps with an adjacent portion packet, wherein the portion packets are arranged in a first sequence being a full circle, a semi-circle or any other part of a circle and in a second sequence, being a full circle, a semi-circle or any other part of a circle, preferably being concentric with the first sequence.

When the portion packets are arranged in a sequence being a full circle, a semi-circle or any other part of a circle, the display pattern may form a polygon or a part of a polygon, wherein the number of sides in the polygon equals the number of portion packets.

This disclosure further relates to a container comprising a plurality of portion packets of a product for oral use, the portion packet having a minimal extension s. The portion packets are arranged in a first sequence being a full circle, a semi-circle or any other part of a circle. A center space located at a center of the circle is free from portion packets. The center space has a diameter $d_s$, wherein $d_s \geq s$, and yet $d_s \leq d_c - 2s$, wherein $d_c$ is a diameter of the container. The size and the location of the center space may correspond to that of the center column in the compartment unit. The center space may be used to dispose of used portion packets, e.g. in a disposal container located in the free center space. If the portion packet has a pillow-like shape as mentioned above, typically substantially rectangular, the minimal extension would be the width of the portion packet.

The containers described herein comprising a plurality of portion packets are suitably closed by a corresponding lid, which will help the packaging pattern of the portion packets to remain stable, even if the container is carried around in a pocket of the user and/or if the container is shaken.

BRIEF DESCRIPTION OF THE DRAWINGS

The present invention will hereinafter be further explained by means of non-limiting examples with reference to the appended drawings wherein.

It should be noted that the appended drawings are schematic and that individual components are not necessarily drawn to scale and that the dimensions of some features of the present invention may have been exaggerated for the sake of clarity.

DETAILED DESCRIPTION

The invention will, in the following, be exemplified by embodiments. It should however be realized that the embodiments are included in order to explain principles of the invention and not to limit the scope of the invention, as defined by the appended claims. Details from two or more of the embodiments may be combined with each other.

Figure 1:
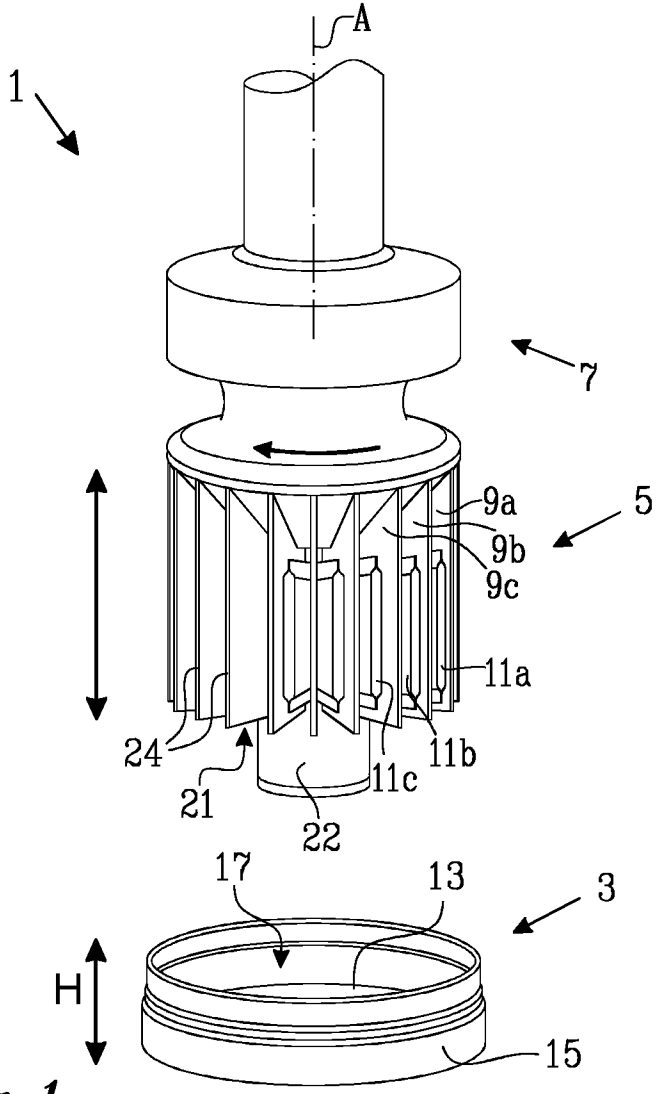
FIG. 1 is a schematic view of a first embodiment of a device for positioning portion packets of a product for oral use into a container, FIG. 2 schematically illustrates a portion packet.

FIG. 1 illustrates a first embodiment of a device 1 for positioning portion packets of a product for oral use into a container 3. The device comprises a compartment unit 5 and a positioning unit 7. The compartment unit 5 forms a rigid structure, which comprises a plurality of compartments 9*a*, 9*b*, 9*c*, . . . for receiving at least one portion packet 11*a*, 11*b*, 11*c*, . . . . The positioning unit 7, whereof only a portion is shown in FIG. 1, is adapted to position the compartment unit 5 in relation to the container 3. The compartment unit 5 of FIG. 1 is shown in a cross-sectional view in FIG. 3*a*.

The container 3 has a height direction H. The container 3 comprises a bottom wall 13, extending perpendicularly to the height direction H and a side wall 15 extending in the height direction H. The bottom wall 13 and the side wall 15 define a storage volume 17. In the illustrated embodiment of FIG. 1, the container 3 has a circular cross-section but other shapes of the cross-section are feasible, e.g. a semi-circle or another or part of a circle. It would also be feasible to have a substantially rectangular container or any other suitable container shape. If rectangular, the portion packets may be arranged in one, two, three or more parallel lines. Square is herein seen as a special case of rectangular. The container 3 may be made of plastics, metal and/or cardboard.

Each compartment 9*a*, 9*b*, 9*c*, . . . is adapted to receive at least one portion packet 11*a*, 11*b*, 11*c*, . . . per compartment. In the illustrated embodiment of FIG. 1, each compartment 9*a*, 9*b*, 9*c*, . . . is adapted to receive a single portion packet, but it would also be feasible that a single compartment 9*a* comprises two, three or more portion packets, e.g. as illustrated in FIG. 6*a*.

Each compartment 9*a*, 9*b*, 9*c*, . . . has an entrance end 19, at which a portion packet 11*a*, 11*b*, 11*c*, . . . may be introduced into the compartment 9*a*, 9*b*, 9*c*, a retaining end 20 opposite the entrance end 19 and a discharge opening 21 adapted to face the container 3. This is best seen in FIG. 3*a*. The retaining end 20 prevents the portion packet 11*a*, 11*b*, 11*c*, . . . from further movement when being introduced. The discharge opening 21 faces in a direction being perpendicular to a straight line drawn between the entrance end 19 and the retaining end 20, i.e. the discharge opening 21 is directed towards the container 3. The compartment 9*a*, 9*b*, 9*c*, . . . is delimited sideways by wall members 24, which are adapted to hold the portion packet 11*a*, 11*b*, 11*c*, . . . located in the compartment 9*a*, 9*b*, 9*c*, . . . , such that the portion packet 11*a*, 11*b*, 11*c*, . . . assumes a first three-dimensional orientation. In the illustrated embodiment of FIG. 1, the compartment unit 5 has a circular cross-section with wedge-shaped compartments 9*a*, 9*b*, 9*c*, . . . , which are arranged side-by-side, such that a single wall member 24 forms a dividing wall between two adjacent compartments. In the illustrated embodiment, the dividing wall members 24 are equidistantly spaced. However, it is to be understood that non-equidistant dividing wall members may alternatively be used.

The positioning unit 7 is adapted to displace the compartment unit 5 in a first displacement motion in the axial direction A, which is parallel to the height direction H of the container 3. The positioning unit 7 may also, as an option, be adapted to displace the compartment unit 5 in a second displacement motion in a reconfiguration plane being perpendicular to the axial direction A and thus also perpendicular to the height direction H of the container 3. In the illustrated embodiment, the optional second displacement motion is a rotation around the axial direction A. If the container 3 has a cross-section forming a circle, as illustrated, a semi-circle or another part of a circle, the axial direction A preferably goes through the center of the circle, as illustrated.

If the container is a substantially rectangular, the second displacement motion may instead be a linear translational movement in the reconfiguration plane. In addition, combinations of linear translational movement and rotations in the reconfiguration plane are possible.

As an option, illustrated in FIG. 1, the device 1 may comprise a center column 22 located at a center of the compartment unit 5. The center column 22 is displaceable in relation to the compartments 9*a*, 9*b*, 9*c*, . . . in the axial direction A. The center column 22 may e.g. be spring-biased, such that the center column 22 protrudes from the compartments 9*a*, 9*b*, 9*c*, when the compartment unit 5 is positioned spaced from the bottom wall 13 of the container 3, as is illustrated in FIG. 1. The center column 22 may be used to help to keep the portion packets 11*a*, 11*b*, 11*c*, . . . in place during the first displacement motion and/or the optional second displacement motion, as is further explained below in conjunction with FIG. 5.

Figure 2:
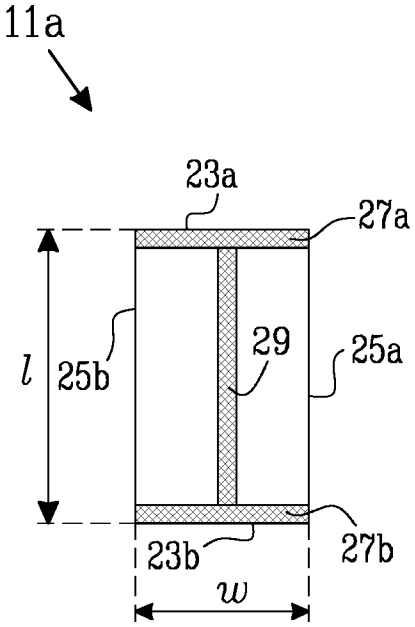

FIG. 2 illustrates one of the portion packets. The portion packet 11*a* has a pillow-like shape, which typically is substantially rectangular, when seen from its largest side, as is illustrated in FIG. 2. The portion packet 11*a* has a length l and a width w. The shape comprises two parallel short edges 23*a*, 23*b* and two parallel long edges 25*a*, 25*b*, which are perpendicular to the short edges 23*a*, 23*b*. In the illustrated embodiment a respective transverse seam 27*a*, 27*b* is arranged at each of the short edges 23*a*, 23*b*. A longitudinal seam 29 extends between the short edges 23*a*, 23*b*, such that the longitudinal seam 29 is parallel to the long edges 25*a*, 25*b*. However, the longitudinal seam 29 is typically not located at the long edges 25*a*, 25*b*. Instead it may for example be located substantially halfway between the long edges 25*a*, 25*b*, as is illustrated in FIG. 2.

Figure 3B:
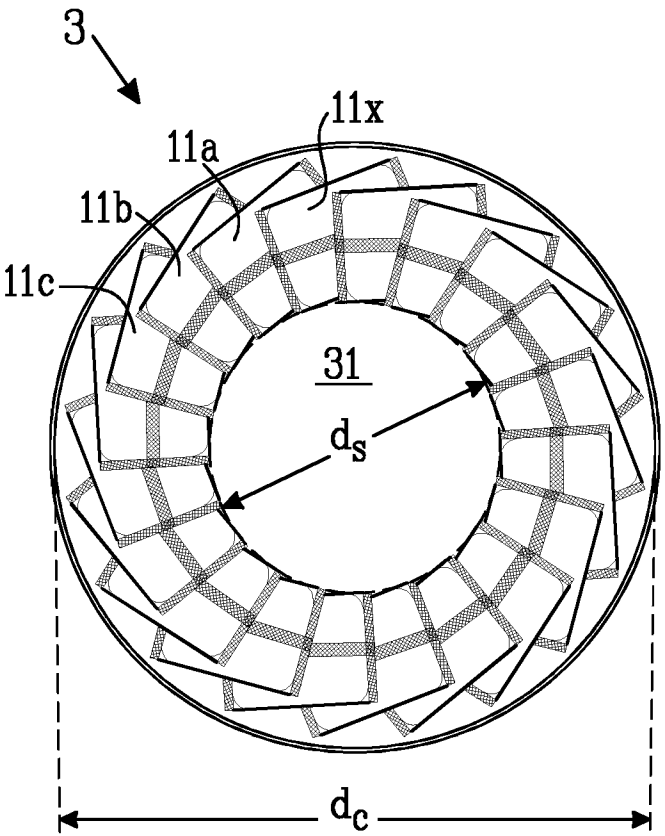
FIG. 3*a-b* illustrate a compartment unit of the device of FIG. 1 and the corresponding pattern of portion packets in the container.
Figure 3A:
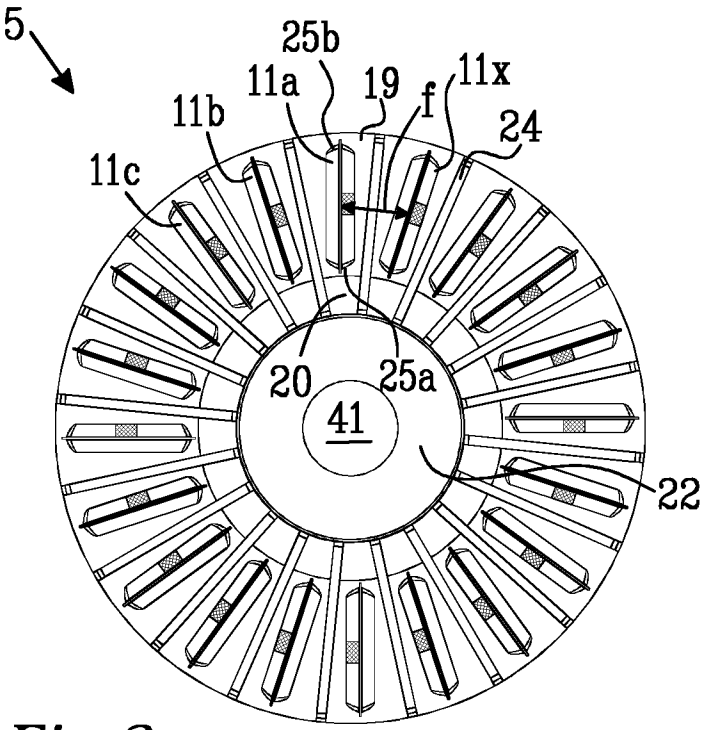
Figure 6B:
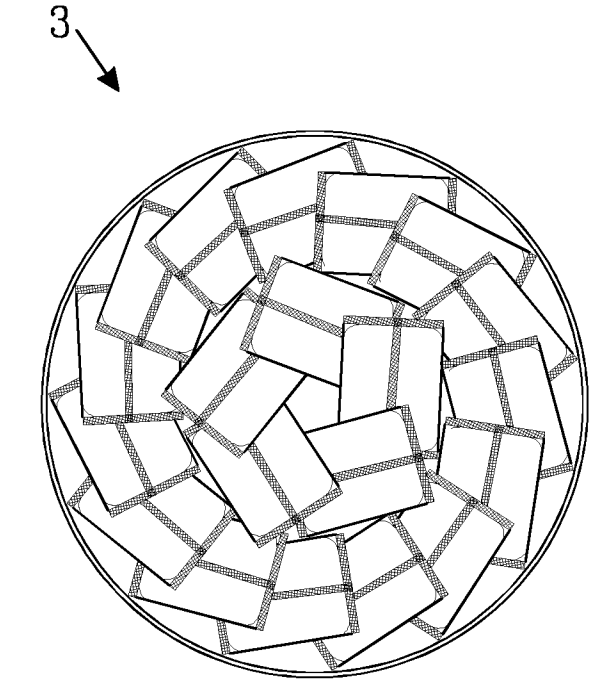
FIG. 6*a-b* illustrate a second embodiment of a compartment unit and corresponding pattern of portion packets in the container.
Figure 6A:
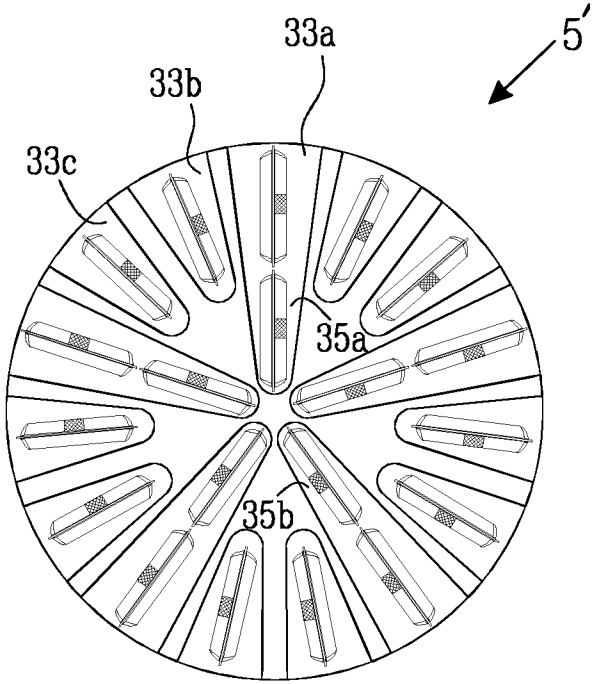
Figure 7B:
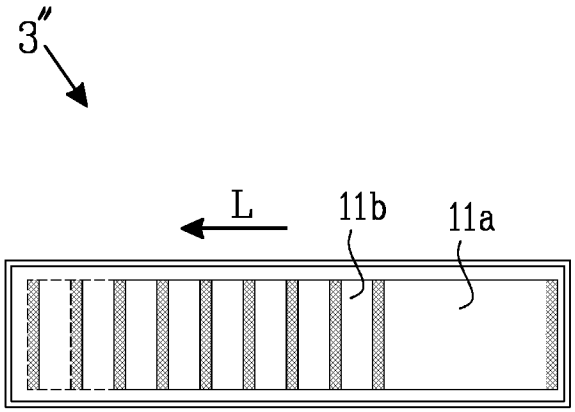
FIG. 7*a-b* illustrate a third embodiment of a compartment unit and corresponding pattern of portion packets in the container.
Figure 7A:
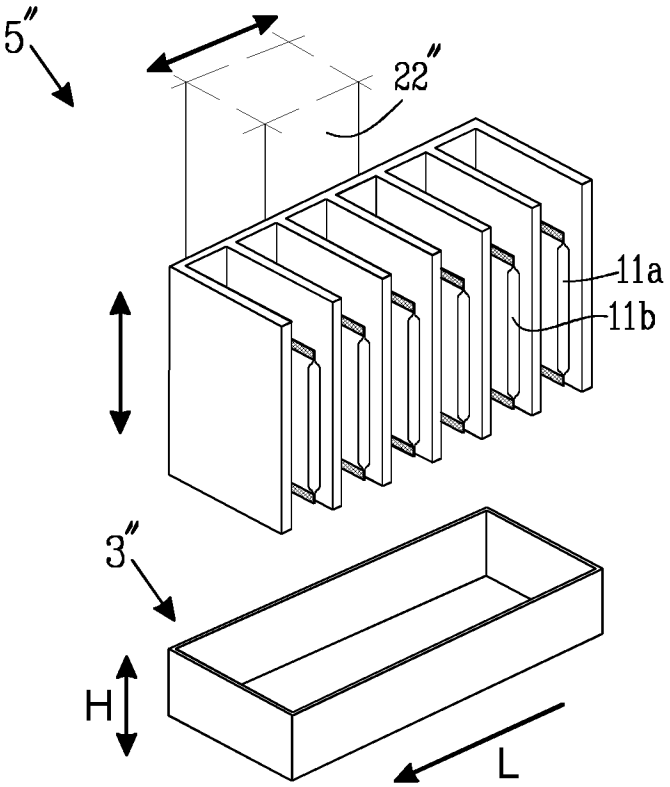

FIGS. 3*a*, 6*a* and 7*a* illustrate different embodiments of compartment units 5, 5', 5", while FIGS. 3*b*, 6*b* and 7*b* illustrate the corresponding pattern of portion packets, which is obtained after the portion packets have been discharged into the container 3, 3". In the containers 3, 3", each portion packet assumes a second three-dimensional orientation, which is different from the first three-dimensional orientation. Typically, and as is common for the three embodiments of FIGS. 3*b*, 6*b* and 7*b* illustrating different packaging patterns of the portion packets in the containers 3, 3", one portion packet partly overlaps with an adjacent portion packet, i.e. it lies partly on top of it. Further, according to the invention, it is possible to obtain a regular packaging pattern, i.e. the portion packets partly overlap with each other in a similar and pre-definable way. The overlap helps the portion packets to retain their relative positions, resulting in a stable distribution of portion packets within the container.

FIG. 3*a* is a cross-section of the compartment unit 5 of FIG. 1. The compartments 9*a*, 9*b*, 9*c*, . . . are arranged in a first sequence forming a full circle. In the container 3 having a diameter de, the portion packets 11*a*, 11*b*, 11*c*, . . . are arranged in a corresponding circular pattern, see FIG. 3*b*, wherein the portion packets 11*a*, 11*b*, 11*c*, . . . form a polygon. The number of sides of the polygon equals the number of portion packets.

A center space 31 located at a center of the circle is free from portion packets 11*a*, 11*b*, 11*c*, . . . . The center space 31 has a diameter $d_s$, wherein $d_s \geq s$, and yet $d_s \leq d_c - 2s$, wherein s is a minimal extension of the portion packets 11*a*, 11*b*, 11*c*, i.e. the width w of the portion packet 11*a*, 11*b*, 11*c* illustrated in FIG. 2. The size and the location of the center space 31 correspond to that of the center column 22 in the compartment unit 5. The center space 31 may be used to dispose of used portion packets, e.g. in a disposal container, which may be located in the free center space 31, however not illustrated.

The distance f from one portion packet 11*a* to the adjacent portion packet 11*b* when located in the compartment unit 5, see FIG. 3*a*, is less than the extension of the portion packets 11*a*, 11*b*, 11*c*, . . . in the height direction H of the container 3, here being the length l. Thereby, the desired configuration of the portion packets 11*a*, 11*b*, 11*c*, . . . in the container 3, such that the portion packets 11*a*, 11*b*, 11*c*, . . . partly overlap each other, is easily obtained. The distance f from one portion packet 11*a* to the adjacent portion packet 11*b* is determined as the smallest distance from a geometrical center of one portion packet to the geometrical center of the adjacent portion packet.

Figure 4:
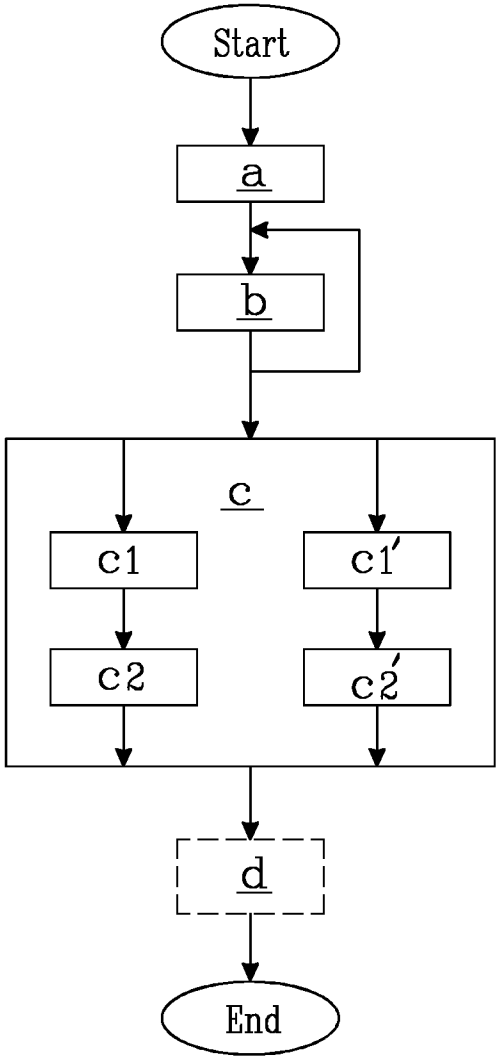
FIG. 4 illustrates a method for positioning portion packets.

FIG. 4 illustrates steps of a method for positioning portion packets of a product for oral use into a container by means of a compartment unit. Below, the method is described when using the compartment unit 5 of FIG. 1. FIGS. 5*a-e* illustrate cross-sections of the container 3 and the compartment unit 5 of FIG. 1 during different steps of the method.

The method comprises:

a) positioning the compartment unit 5 at a first distance $d_1$ from the bottom wall 13 of the container with the discharge openings 21 facing the storage volume 17 of the container 3. See FIG. 5*a*.

b) introducing at least one portion packet 11*a* into an i-th compartment of the compartment unit 5, the portion packet 11*a* thereby assuming a first three-dimensional orientation with the at least one portion packet being in contact with the bottom wall 13 of the container 3 and at least partly remaining in the i-th compartment. See FIG. 5*a*.

In step b, i is an integer going from 1 to n, n being the number of compartments 9*a*, 9*b*, 9*c*, . . . to be loaded, n≥2. If there is to be a single portion packet in each compartment, the number of portion packets intended to be positioned in the container 3 will also equal n. However, the number of portion packets in the container may also be higher than n, if placing more than a single portion packet in the compartment, as is further explained below.

The step of introducing a portion packet, i.e. step b, is repeated for each compartment to be loaded. If the compartment unit 5 has a circular cross-section, as is illustrated in FIGS. 1 and 3*a*, it is suitable to rotate the compartment unit by 360°/n between each introduction of a portion packet. If instead the compartment unit 5" has a rectangular cross-section, it is suitable to linearly translate the compartment unit by the length of compartment unit divided by n between each introduction of a portion packet, cf. FIG. 7*a*.

As mentioned above, the introduction of portion packets is made with the compartment unit 5 being at the first distance $d_1$. The first distance $d_1$ is preferably less than an extension of the portion packets 11*a*, 11*b*, 11*c*, in the height direction H of the container. In the illustrated embodiment, see FIG. 5*a*, the portion packets 11*a*, 11*b*, 11*c*, . . . stand on one of their short edges 23*a* on the bottom wall 13 of the container, hence the extension equals the length l of the portion packet and it is preferred that $0 \leq d_1 < l$. If instead standing on a long edge 25*a*, 25*b*, the extension equals the width w of the portion packet it would be preferred that $0 \leq d_1 < w$. Thereby, the portion packets 11*a*, 11*b*, 11*c*, . . . will at least partly be retained in the compartments 9*a*, 9*b*, 9*c* . . . . One of the long edges 25*a* of the portion packet 11*a* is directed towards the retaining end 20 and the other long edge 25*b* is directed towards the entrance end 19. Preferably, $d_1$ is very small, i.e. close to zero, as in FIG. 5*b*, but yet large enough to allow the compartment unit 5 to rotate in relation to the container 3, which will facilitate sequentially introducing the portion packets 11*a*, 11*b*, 11*c*, . . . in the compartments 9*a*, 9*b*, 9*c* . . . .

The method further comprises:

c) moving the compartment unit 5, 5', 5" in relation to the container 3, 3" thereby causing reconfiguration of each portion packet 11*a*, 11*b*, 11*c*, . . . to a second three-dimensional orientation being different from the first three-dimensional orientation.

Step c may be performed by:

c1) moving the compartment unit 5, 5', 5" in relation to the container 3, 3" by relative movement in the height direction H of the container 3, 3" at least until each portion packet 11*a*, 11*b*, 11*c*, . . . is located outside the corresponding compartment 9*a*, 9*b*, 9*c*, . . . , and c2) allowing each portion packet 11*a*, 11*b*, 11*c*, . . . to fall down on an adjacent portion packet 11*a*, 11*b*, 11*c*, . . . , such that one portion packet partly overlaps with the adjacent portion packet in the second three-dimensional orientation.

Since the compartments 9*a*, 9*b*, 9*c* . . . are larger than the portion packets 11*a*, 11*b*, 11*c*, . . . , the portion packet 11*a*, 11*b*, 11*c*, . . . tend to be somewhat inclined in first three-dimensional orientation. See FIG. 3*a*. The first three-dimensional orientation may also be influenced by the compartment unit 5 being moved during introduction of the portion packets 11*a*, 11*b*, 11*c*, . . . . In the illustrated example, the compartment unit 5 is for example stepwise rotated during the introduction.

Figure 5A:
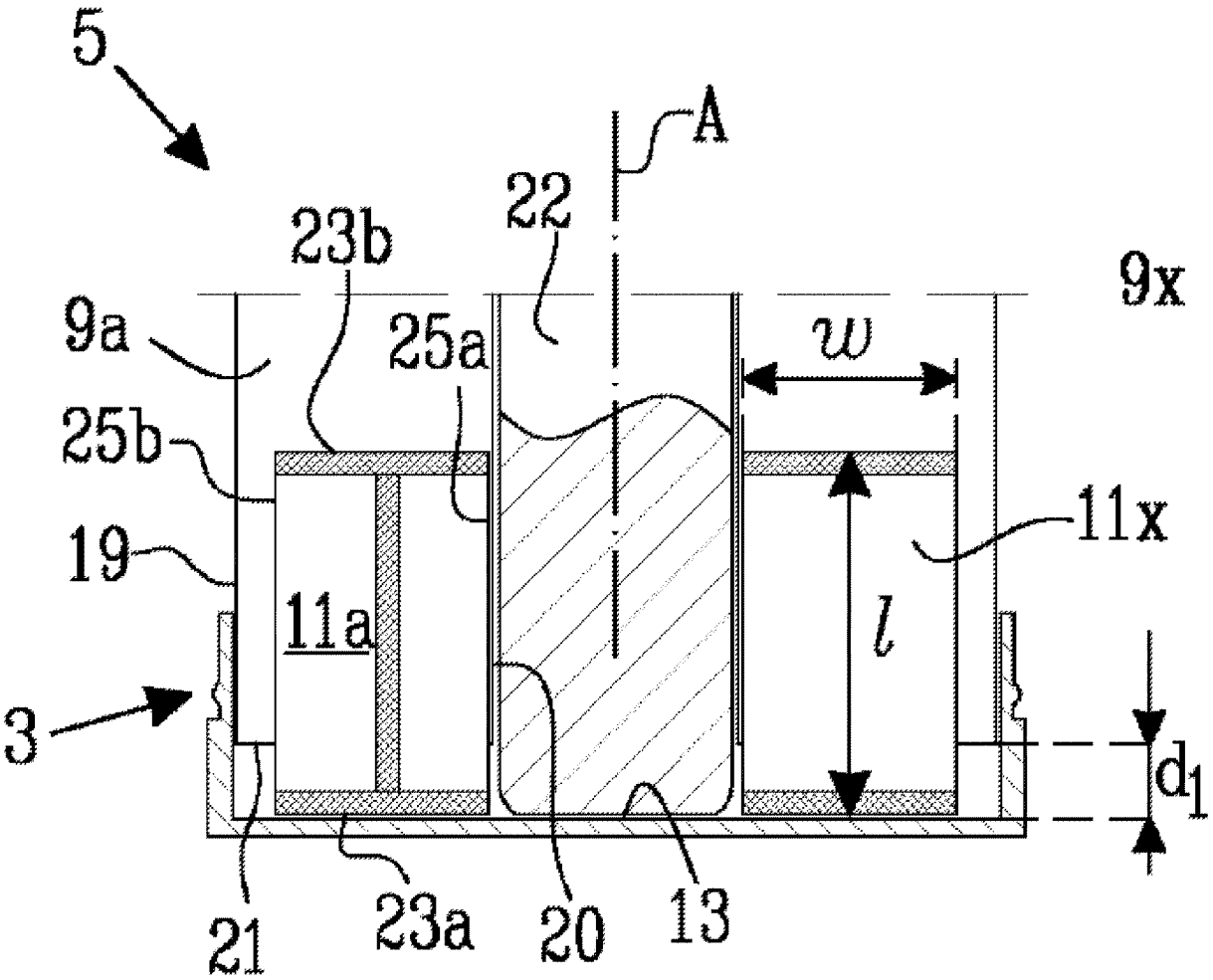
FIGS. 5*a-e* illustrate cross-sections of the container and the compartment unit of FIG. 1 during different steps of the method.
Figure 5B:
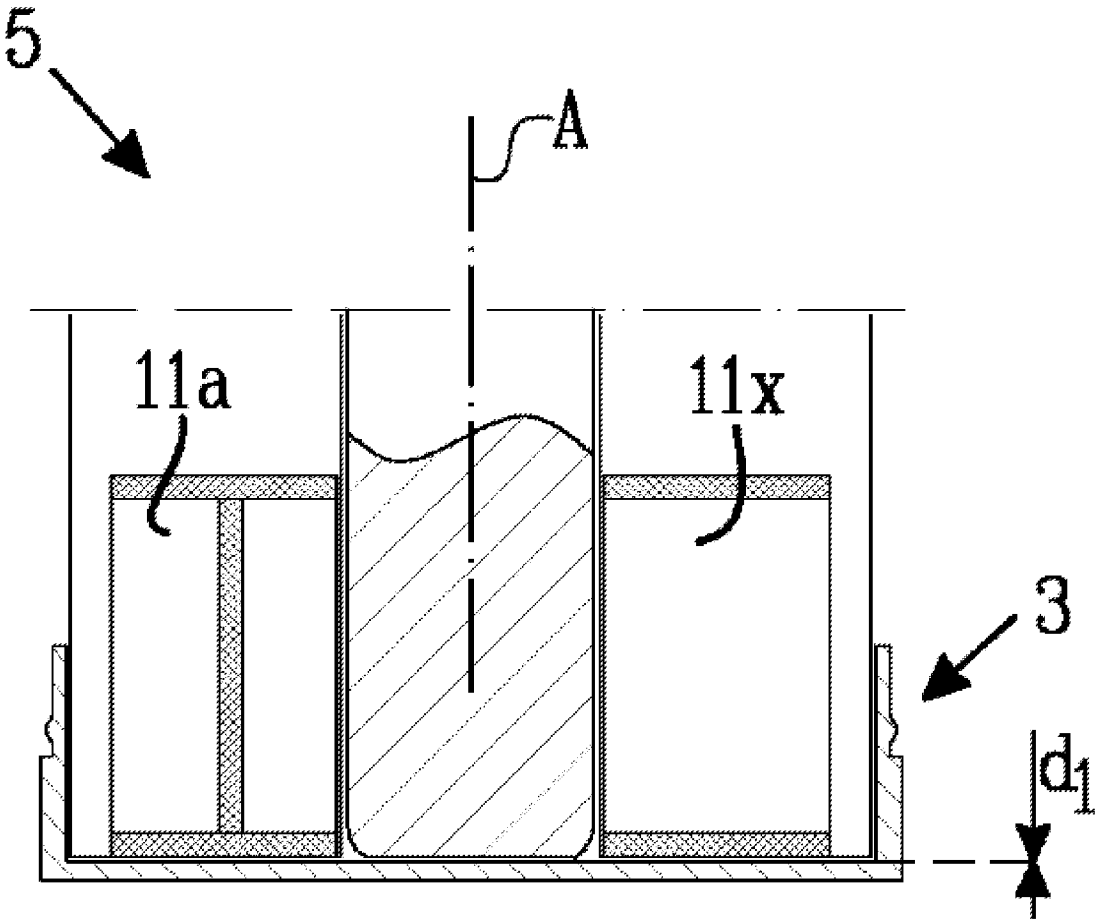
Figure 5C:
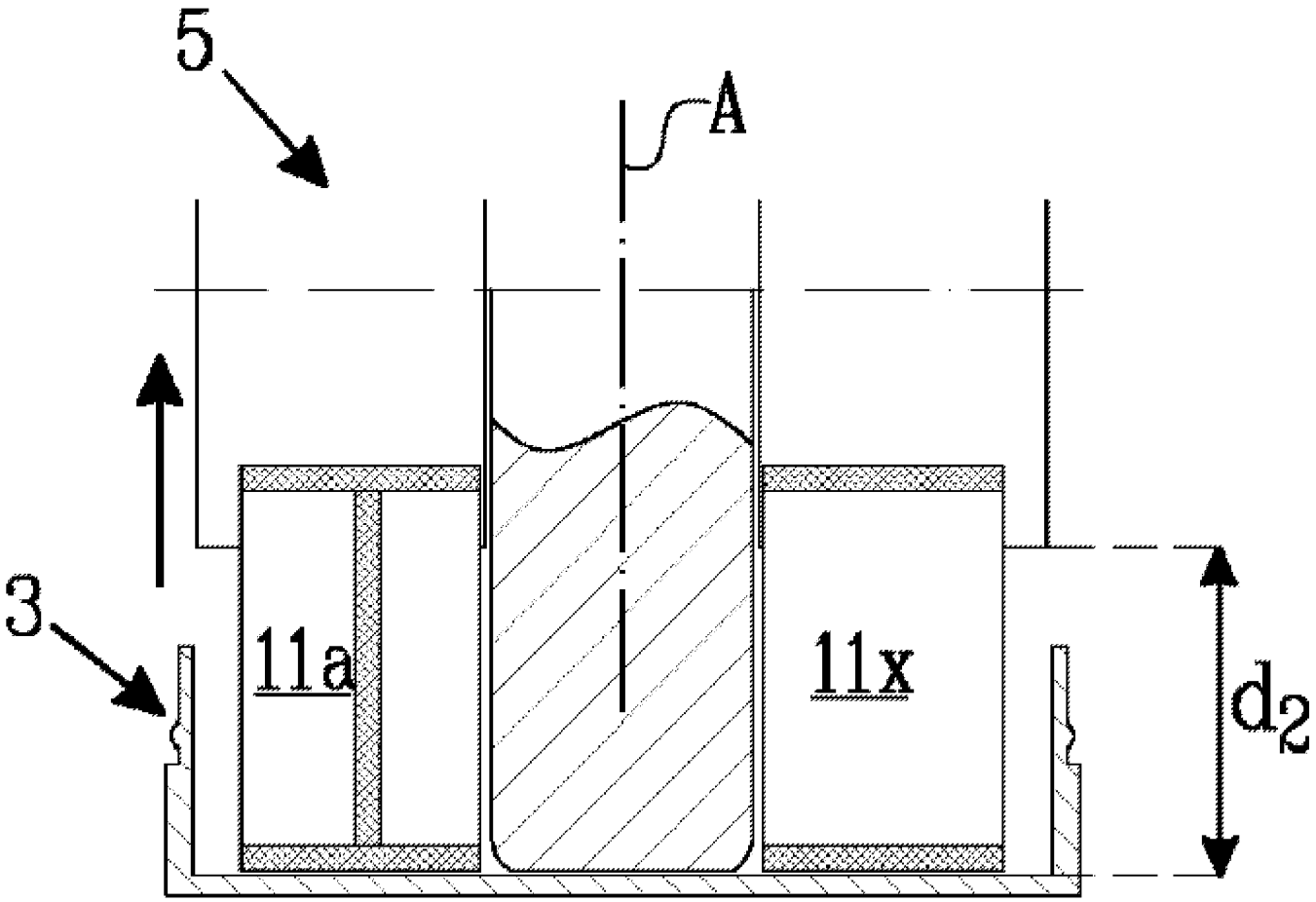
Figure 5D:
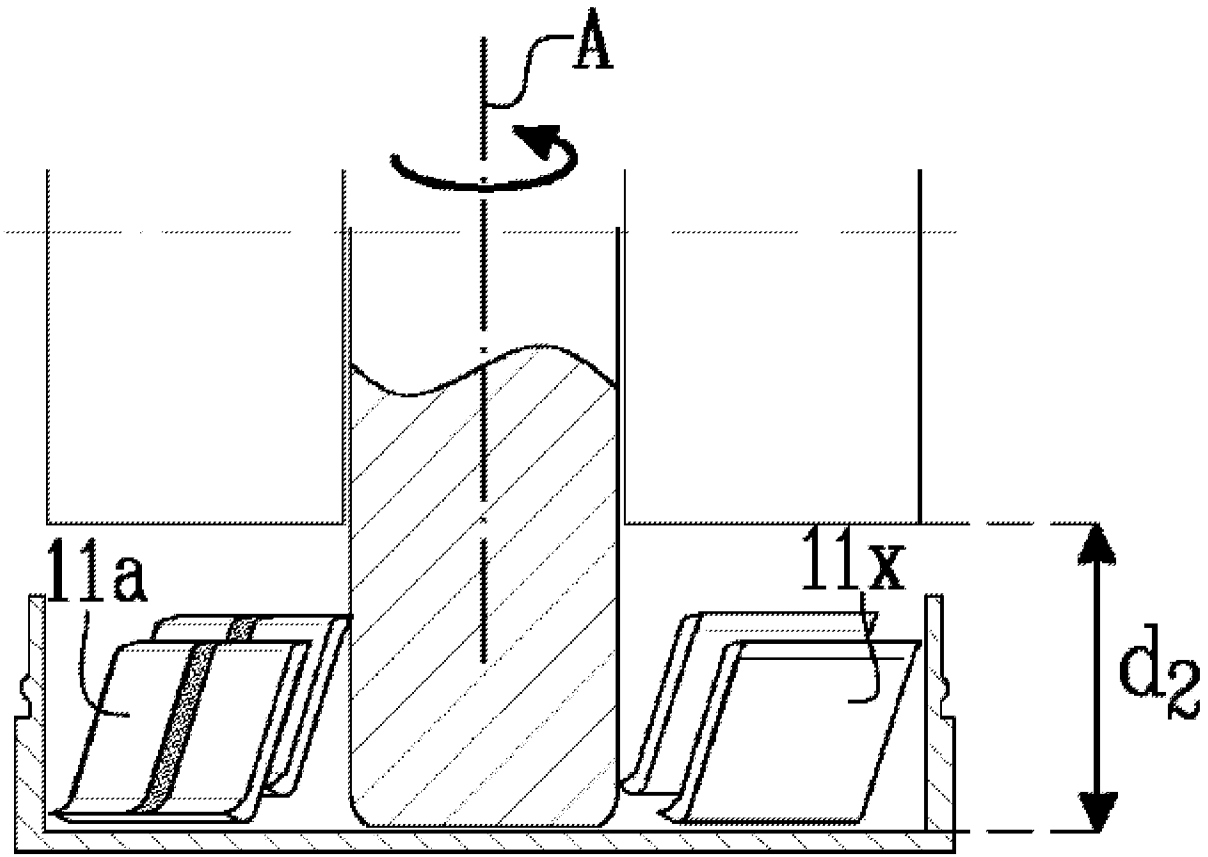
Figure 5E:
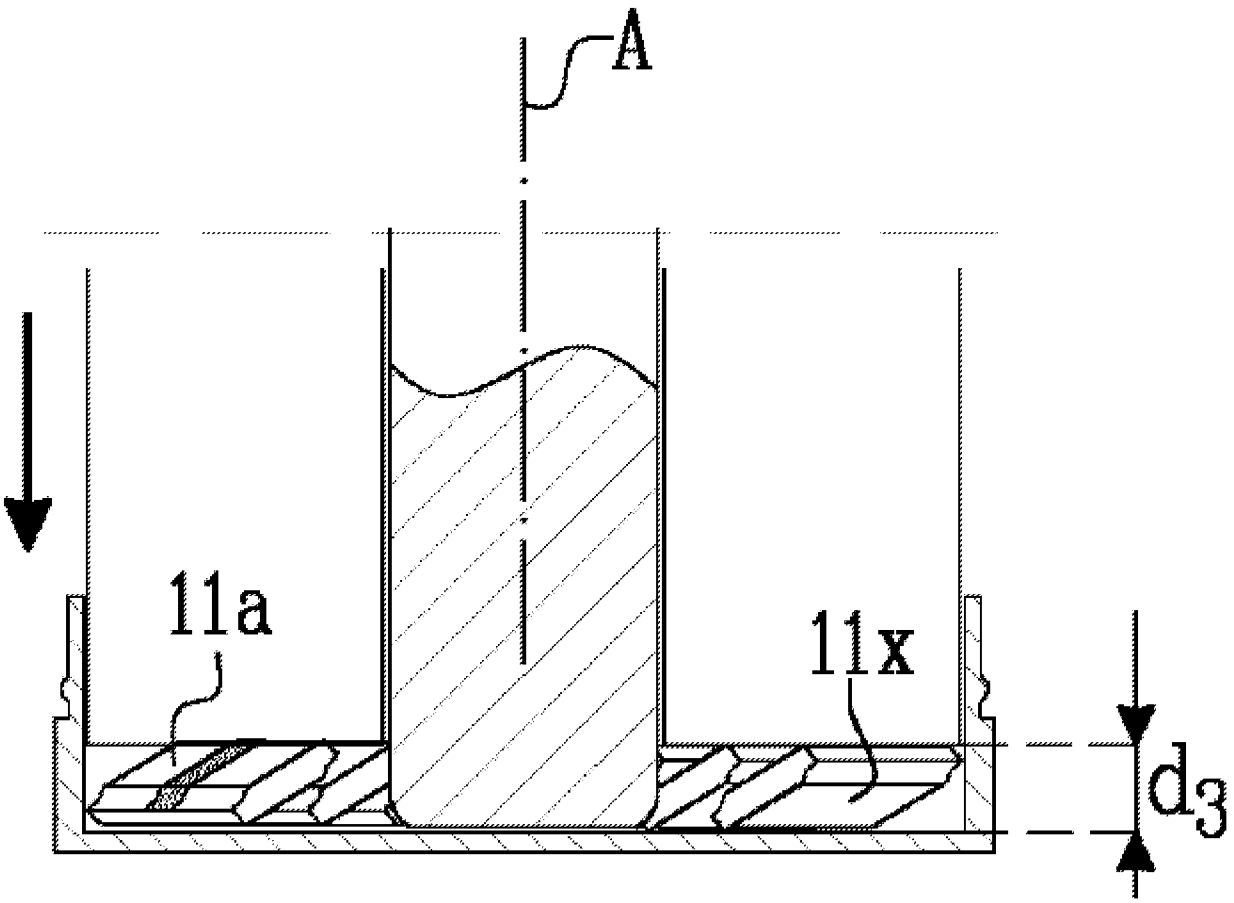

When the compartment unit 5 has been raised in relation to the container 3 in step c1', the whole portion packets 11*a*, 11*b*, 11*c*, . . . are located outside the compartment unit 5 and will therefore fall down. Due to the somewhat inclined first three-dimensional orientation, the portion packet 11*a*, 11*b*, 11*c*, . . . has a preferred falling direction and will tilt about the lower short edge 23*a*. Thereby the portion packets 11*a*, 11*b*, 11*c*, . . . will be brought to the second three-dimensional orientation, which is seen in FIGS. 3*b* and 5*d*. Due to the regular arrangement of the compartments 9*a*, 9*b*, 9*c* . . . the portion packets 11*a*, 11*b*, 11*c*, . . . will fall down in a staggered, domino-like pattern as is illustrated in FIG. 3*b*.

As an alternative to the above way of performing step c, step c may be performed by: c1') positioning the compartment unit 5 in relation to the container 3 at a second distance $d_2$ from the bottom wall 13 of the container 3, wherein a portion of each portion packet 11*a*, 11*b*, 11*c*, . . . is outside the corresponding compartment 9*a*, 9*b*, 9*c*, and another portion of each portion packet 11*a*, 11*b*, 11*c*, . . . is inside the corresponding compartment 9*a*, 9*b*, 9*c*, . . . . See FIG. 5*c*.

c2') moving the compartment unit 5 in relation to the container 3 by relative movement of the compartment unit 5 in a reconfiguration plane being perpendicular to the height direction H of the container 3, when positioned at the second distance $d_2$ from the bottom wall 13 of the container 3, thereby causing reconfiguration of each portion packet 11*a*, 11*b*, 11*c*, . . . to the second three-dimensional orientation. See FIG. 5*d*.

In step c1', the compartment unit 5 is positioned at the second distance $d_2$ from the bottom wall 13 of the container 3. In the illustrated embodiment, the portion packets 11*a*, 11*b*, 11*c*, . . . stand on one of their short edges 23*a* on the bottom wall 13 of the container 3, hence $d_2 < l$. Suitably, $0.25\ l < d_2 < 0.99\ l$, or preferably $0.4\ l < d_2 < 0.95\ l$, or more preferably $0.6\ l < d_2 < 0.95\ l$, here illustrated as 0.8 l.

When the compartment unit 5 is displaced in relation to the container 3 in step c2' by movement in the reconfiguration plane, an upper portion of the portion packet 11*a*, 11*b*, 11*c*, . . . will be moved by the compartment unit 5, while a lower portion of the portion packet 11*a*, 11*b* . . . remains with the short edge 23*a* in contact with the bottom wall 13 of the container 3, such that the portion packet 11*a*, 11*b*, 11*c*, . . . is tilted about the lower short edge 23*a*. Thereby the portion packets 11*a*, 11*b*, 11*c*, . . . will be brought to the second three-dimensional orientation, which is seen in FIGS. 3*b* and 5*d*. In the illustrated embodiment, the second displacement motion is a rotation in the reconfiguration plane around the axial direction A, which will cause the portion packets 11*a*, 11*b*, 11*c*, . . . to fall down in a staggered, domino-like pattern as is illustrated in FIG. 3*b*.

As an option, the method may comprise:

d) displacing the compartment unit 5 in relation to the container 3 in the height direction H of the container 3, such that the compartment unit 5 applies pressure to the portion packets 11*a*, 11*b*, 11*c*, . . . when assuming the second three-dimensional orientation. See FIG. 5*e*.

Thereby the portion packets 11*a*, 11*b*, 11*c*, . . . may be locally compressed by means of the compartment unit 5. This will help to retain a stable configuration of the portion packets 11*a*, 11*b*, 11*c*, . . . in the container 3. The pressure is applied with the compartment unit 5 being at a third distance $d_3$ from the bottom wall 13 of the container 3 being less than the second distance $d_2$.

FIG. 6*a* illustrates a cross-section of an alternative compartment unit 5'. Similar as for FIG. 3*a*, the portion packets 11*a*, 11*b*, 11*c*, . . . have one of their short edges 23*a*, 23*b* directed towards the container 3. The compartments forms a first sequence 33*a*, 33*b*, forming a full circle, corresponding to that of FIG. 3*a*. There is also a second sequence 35*a*, 35*b*, . . . forming a full circle inside the first sequence, such that the second sequence is concentric with the first sequence. A position 35*a* in the second sequence is reached via a position 33*a* of the first sequence. When loading, there is first introduced a portion packet in the position 35*a* of the second sequence and thereafter a portion packet is introduced into the position 33*a* of the first sequence. The already introduced portion packet in the second sequence 35*a* will then block the portion packet of the first sequence 33*a* from getting any closer to the center of the circle. It is preferred that the number of positions 33*a*, 33*b*, . . . in the first sequence is a multiple of the number of positions 35*a*, 35*b* in the second sequence. In the illustrated embodiment, there are fifteen positions in the first sequence and five in the second sequence. The compartments have two different sizes, adapted either for two portion packets, i.e. 33*a* and 35*a*, or adapted for one portion packet 33*b*, 33*c*.

In the container 3, the five portion packets of the second sequence form a pentagon, surrounded by the fifteen portion packets of the first sequence substantially forming a polygon with fifteen sides. There may be a small center space without portion packets, or the bottom wall 13 of the container 3 may be substantially covered as in FIG. 6*b*.

FIG. 7*a* illustrates a cross-section of yet an alternative compartment unit 5". Similar as for FIG. 3*a*, the portion packets 11*a*, 11*b*, 11*c*, have one of their short edges 23*a*, 23*b* directed towards the container 3", which in this embodiment is rectangular and has a longitudinal direction L, see FIG. 7*b*. The alternative compartment unit 5" may be loaded by stepwise relative linear translational movement in the longitudinal direction L, such that the portion packets 11*a*, 11*b*, 11*c*, . . . are introduced one by one. The portion packets may be arranged in one, two, three or more parallel lines in the container.

Step c may be performed by steps c1 and c2 above. Since the compartments are larger than the portion packets, the portion tend to be somewhat inclined in first three-dimensional orientation, see FIG. 7*a*. The first three-dimensional orientation may also be influenced by the stepwise relative linear translational movement during introduction of the portion packets. Due to the somewhat inclined first three-dimensional orientation, the portion packet has a preferred falling direction and will tilt about the lower short edge. Thereby the portion packets will be brought to the second three-dimensional orientation, which is seen in FIG. 7*b*. Due to the regular arrangement of the compartments the portion packets will fall down in a staggered, domino-like pattern.

Alternatively, step c may be performed by steps c1' and c2' above. Then a second displacement motion, which is a linear translational movement in the reconfiguration plane in the longitudinal direction L, may be utilized. An upper portion of the portion packet 11*a*, 11*b*, 11*c*, . . . will be moved by the compartment unit 5", while a lower portion of the portion packet 11*a*, 11*b* remains with one of the short edges 23*a*, 23*b* in contact with the bottom wall of the container 3", such that the portion packet 11*a*, 11*b*, 11*c*, . . . is tilted about the lower short edge. Thereby the portion packet 11*a*, 11*b*, 11*c*, . . . will be brought to the second three-dimensional orientation, which is seen in FIG. 7*b*, in which the portion packets 11*a*, 11*b*, 11*c*, . . . partly overlap.

Even if the embodiments illustrated in FIGS. 3*b*, 6*b* and 7*b* illustrate portion packets abutting the bottom wall 13 with one of their short edges 23*a*, 23*b*, it would also be possible according to the invention described herein to have a packaging pattern in which the portion packets abut with one of their long edges 25*a*, 25*b* or with one of the sides of the pillow-shape.

Figure 9:
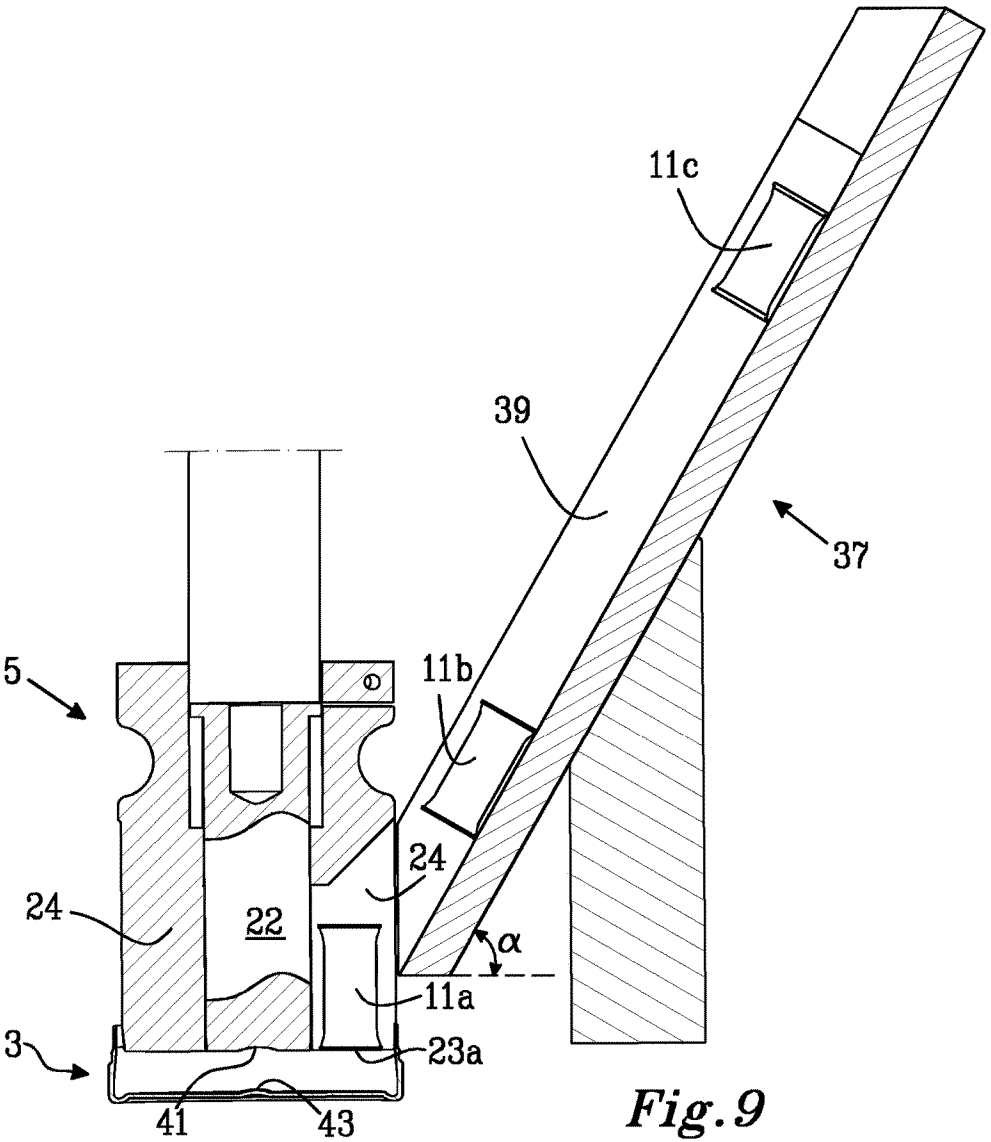
FIG. 9 illustrates a cross-section through the device of FIG. 8.
Figure 8:
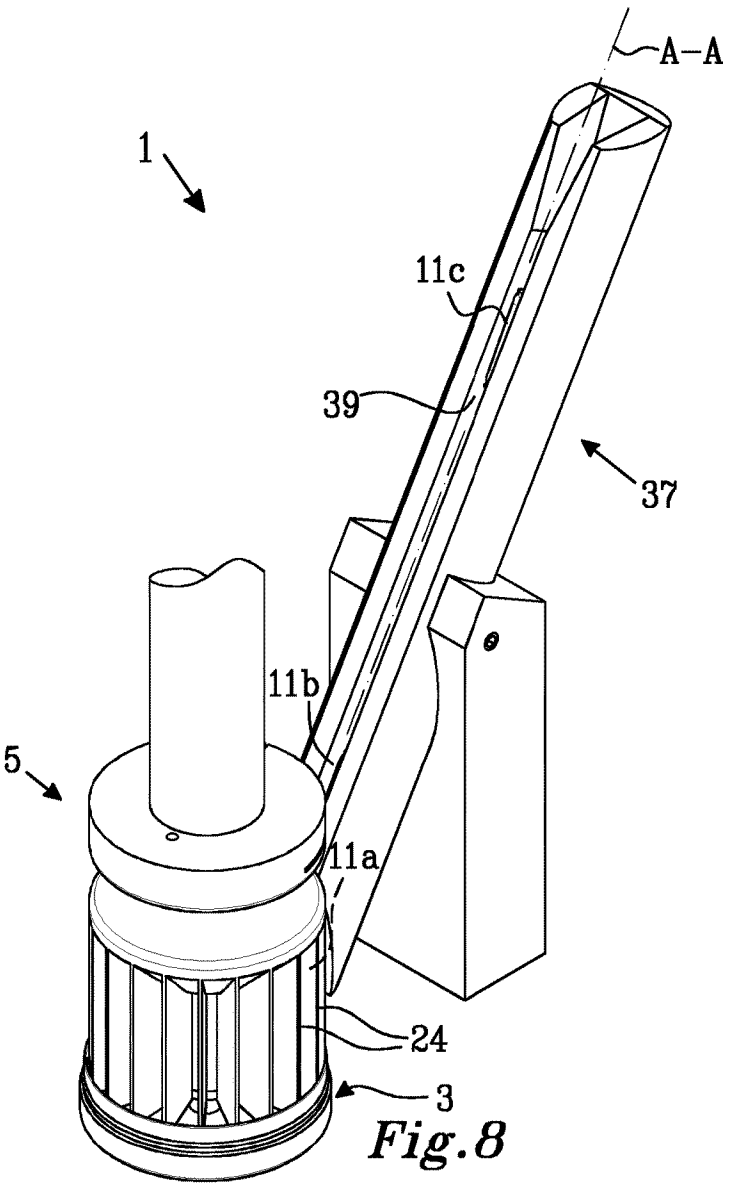
FIG. 8 illustrates a device according to the invention comprising a transport unit.

The device 1 may further comprise a transport unit 37 configured to transport individual portion packets 11*a*, 11*b*, 11*c*, . . . to the compartment unit 5, see FIGS. 8 and 9, wherein FIG. 9 shows a cross-section along line A-A in FIG. 8. The transport unit 37 comprises a product channel 39 arranged for transportation of individual portion packets, which may be transported by means gravity and/or pressurized gas. In the illustrated embodiment, the individual portion packets are transported by means of gravity. The product channel 39 forms an angle $\alpha$ to a horizontal plane. If using gravity only, the angle $\alpha$ may be in the range from 30° to 90°, preferably from 40° to 80°, more preferably from 50° to 70°. If using pressurized gas any angle would work since the portion packet 11*a*, 11*b*, 11*c*, . . . will be moved by the pressurized gas.

It is preferred that the product channel 39 is configured to introduce each individual portion packet 11*a*, 11*b*, 11*c*, . . . into the compartment with a predefined three-dimensional orientation in relation to the compartment, more preferably such that an edge of each portion packet faces a bottom wall of the container 3, most preferably one of the short edges 23*a*, 23*b* of the portion packet 11*a*, 11*b*, 11*c*, . . . .

The method for positioning portion packets is performed as described above. The optional indentation 41 in the center column 22 is adapted to fit on a corresponding protuberance 43 of the bottom wall 13 of the container 3.

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. A container comprising a plurality of portion packets of a product for oral use, wherein said portion packets comprises a pulverulent filling material enclosed by a packaging material, wherein each portion packet of said plurality of portion packets is configured to be placed and retained in an oral cavity of a human, said container comprising a bottom wall and a side wall together defining a storage volume, in which said portion packets are contained, said container having a height direction (H), said portion packets having a pillow-like shape, said shape comprising two parallel short edges and two parallel long edges, which are perpendicular to said short edges, said portion packets being arranged such that one portion packet partly overlaps with an adjacent portion packet, characterized in that said portion packets are arranged in a first sequence being a full circle, a semi-circle or any other part of a circle, and said portion packets are arranged such that only one of said two parallel short edges of each said portion packet abuts said bottom wall of said container.

2. The container according to claim 1, wherein said portion packets are arranged in said first sequence being a full circle, a semi-circle or any other part of a circle and in a second sequence, being a full circle, a semi-circle or any other part of a circle being concentric with said first sequence.

3. The container according to claim 2, wherein said portion packets are arranged in a first sequence being a full circle, such that each portion packet in said first sequence partly overlaps with an adjacent portion packet of said first sequence, and in a second sequence, being a full circle concentric with said first sequence, such that each portion packet of said second sequence partly overlaps with an adjacent portion packet of said second sequence.

4. The container according to claim 1, said portion packets having a minimal extensions, wherein said portion packets are arranged in said first sequence being a full circle, a semi-circle or any other part of a circle, and wherein a center space located at a center of said circle is free from said portion packets, said center space having a diameter $d_s$, wherein $d_s \geq s$, and yet $d_s \leq d_c - 2s$, wherein $d_c$ is a diameter of said container.

5. The container according to claim 4, wherein said portion packets are arranged in a first sequence being a full circle such that each portion packet partly overlaps with an adjacent portion packet and wherein said center space located at said center of said circle is free from said portion packets, said center space having a diameter $d_s$, wherein $d_s \geq s$, and yet $d_s \leq d_c - 2s$, wherein $d_c$ is a diameter of said container.

6. The container according to claim 5, wherein said container further comprises a disposal container for used portion packets located in said free center space.

7. The container according to claim 1, wherein said oral cavity of said human is a buccal cavity.

8. The container according to claim 1, wherein said portion packets are arranged in a first sequence being a full circle such that each portion packet partly overlaps with an adjacent portion packet.

9. The container according to claim 1, wherein said pulverulent material is a smokeless tobacco or a smokeless tobacco-free material.

* * * * *